United States Patent [19]

Arai et al.

[11] 4,124,972

[45] Nov. 14, 1978

[54] PROCESS AND APPARATUS FOR PRODUCING YARNS

[75] Inventors: Yoshiyasu Arai, Toyonaka; Meiji Anahara, Kyoto; Masanori Saka, Suzuka; Tokio Kokubu; Kunio Takeuchi, both of Otsu, all of Japan

[73] Assignee: Toyo Bseki Kabushiki Kaisha, Osaka, Japan

[21] Appl. No.: 798,031

[22] Filed: May 18, 1977

[30] Foreign Application Priority Data

Jan. 10, 1977 [JP] Japan ..... 52-1810
Jan. 12, 1977 [JP] Japan ..... 52-2723

[51] Int. Cl.[2] ..... D01H 5/28; D02G 1/04

[52] U.S. Cl. ..... 57/328; 57/333; 57/350

[58] Field of Search ..... 57/51–51.6, 57/36, 77.3, 77.45, 34 B, 157 F, 156

[56] References Cited

U.S. PATENT DOCUMENTS

| | | | |
|---|---|---|---|
| 3,079,746 | 3/1963 | Field, Jr. | 57/51 |
| 3,204,396 | 9/1965 | Foster et al. | 57/77.3 X |
| 3,206,922 | 9/1965 | Nagahara et al. | 57/77.3 |
| 3,490,219 | 1/1970 | Ozawa et al. | 57/34 B |
| 3,683,608 | 8/1972 | Buzano | 57/77.3 |
| 3,861,133 | 1/1975 | Frankfort et al. | 57/157 F X |
| 3,992,865 | 11/1976 | Tuchida et al. | 57/51 |
| 4,024,698 | 5/1977 | Weiss et al. | 57/77.3 X |

*Primary Examiner*—John Petrakes

[57] ABSTRACT

Method and apparatus suitable for producing a spun yarn at high speed from short fibers less than 50 mm. in length. A bundle of fibers having a particular thickness distribution in its width direction is supplied through a fluid jet false-twist nozzle in which a throttle portion connecting the upstream and downstream portions of the yarn passageway is provided non-eccentrically or eccentrically with respect to the downstream portion, and the downstream portion has a fluid conduit opening eccentrically there into and inclined toward the outlet end of the downstream portion. Air preferably containing water at room temperature in the form of mist is used as the fluid jetted through said nozzle.

16 Claims, 12 Drawing Figures

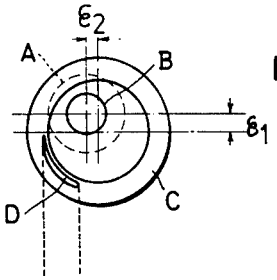
FIG. 4
FIG. 5
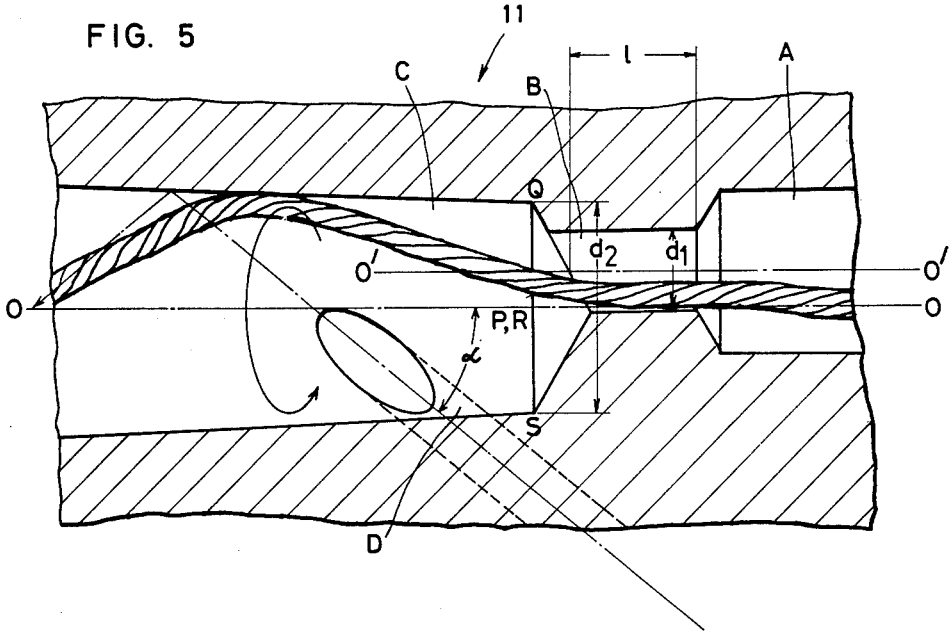
FIG. 6
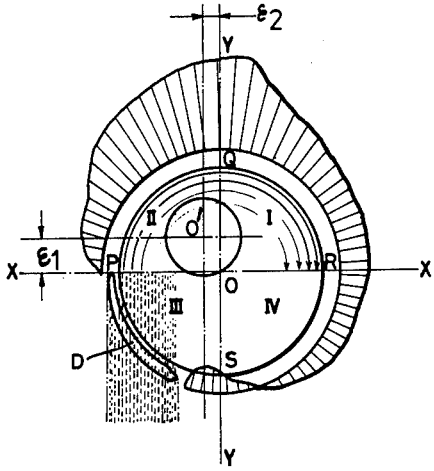

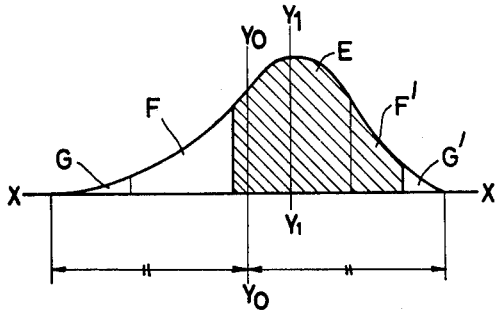
FIG. 9
FIG. 10-1
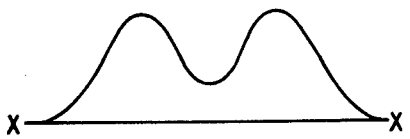
FIG. 10-2
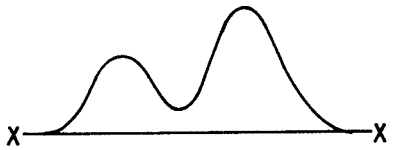
FIG. 11
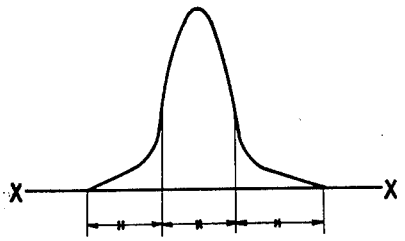

PROCESS AND APPARATUS FOR PRODUCING YARNS

The present invention relates to a spinning method and apparatus suitable for producing a spun yarn at high efficiency and at high speed and yet at low cost from chemical fibers such as regenerated fibers, semi-synthetic fibers or synthetic fibers cut in a definite length or in indefinite lengths, or natural fibers of animal or plant origin, or mixture of such fibers and especially short fibers less than 50 mm. in length.

Among the prior art methods for producing a spun yarn, ring spinning, mule spinning and open-end spinning have been put into practical use. These spinning methods have a limit to the spinning speed because a package or rotor has to be rotated in these methods. In recent years, new technical means have been developed, wherein a spun yarn is obtained by entangling fiber ends around a bundle of fibers by subjecting the bundle of fibers to a twisting and untwisting action, utilizing the rotating action of fluid flow. Representative of such methods is the fluid jet process for twisting yarn disclosed in U.S. Pat. No. 3,009,309. This patent discloses a process for producing a novel yarn with a very simple apparatus, and the yarn thus obtained is named "sheaf yarn" and has a yarn shape wherein the ends of a portion of short fibers are firmly wound around a bundle of substantially parallel fibers in such a way that the ends of the short fibers bundle up the main bundle of fibers at random intervals along its longitudinal direction. Also, the specification of U.S. Pat. No. 3,079,746 discloses a bundled yarn composed of a non-twisted core yarn around which fiber ends are wound at angles of 10°– 80°. These methods achieve a good effect when applied to a bundle of fibers composed of relatively long fibers longer than 100 mm. When short fibers less than 50 mm. in length like cotton fibers are used as the raw material, the fibers are formed into a yarn only with difficulty and by adopting a special measure in which fibers for entanglement are supplied through a manifold, separately from the main bundle. The spinning speed is restricted to a very low speed, for example 40 yds./min. and thus the advantage over the conventional spinning processes is lost to a great extent. In addition, the yarn thus obtained has a low yarn strength and so stability with respect to abrasion and is impractical to use. After intensive study, we have finally devised a series of apparatuses containing a false-twist nozzle suitable for producing spun yarns which makes high speed spinning possible even when supplied with short staple fibers less than 50 mm. in fiber length. In addition thereto, as the fluid, ordinary air or air containing water at room temperature in the form of mist is used, and the drafted bundle of fibers supplied from the front rollers of a draft frame is given an asymmetric thickness distribution in its width direction or a thickness distribution having both wing portions thicker than the central portion, whereby we have achieved a method of obtaining a spun yarn from said fiber bundle at high speed, which yarn has practical physical properties.

An object of the present invention is to provide a method and an apparatus for obtaining a spun yarn having practical properties compared to those of conventional spun yarn, by spinning a bundle of fibers composed of short fibers at high speed.

Another object of the present invention is to provide a high-speed spinning method which can be applied even to a bundle of fibers containing short fibers less than 50 mm. in length.

Another object of the present invention is to increase the aspirating power for a bundle of fibers toward the lower stream portion of the yarn passageway in a false-twist nozzle thereby to raise the operating efficiency and to improve the yarn quality of the spun yarn thus obtained, by using, as the false-twist nozzle for false-twisting a drafted bundle of fibers by fluid flow, a false-twist nozzle having a structure in which the upstream portion and downstream portion of the yarn passageway are connected with a throttle portion having dimensions represented by the following formula:

$$2/\sqrt{Ne} < d_1 < 7/\sqrt{Ne} \quad \text{(I)}$$

$$0.25 \leqq d_1/d_2 \leqq 0.7 \quad \text{(II)}$$

$$1/d_1 < 6 \quad \text{(III)}$$

wherein $d_1$ is the diameter (mm.) of the throttle portion, $d_2$ is the diameter (mm.) of the starting end of the downstream portion of the yarn passageway, $l$ is the length (mm) of the throttle portion in the axial direction, and Ne is the count (English type cotton count) of the yarn to be spun.

A further object of the present invention is to stabilize the twisting power and thus to stabilize the quality of the thus-obtained spun yarn in its longitudinal direction, by positioning the throttle portion, represented by the above-set forth formulae and provided in the yarn passageway of the false-twist nozzle, eccentrically in relation to the downstream portion having a conduit for fluid, toward the side opposite to the fluid conduit.

Another object of the present invention is to increase the entangling effect of the fiber ends and to raise the yarn strength and stability with respect to abrasion, by causing the air jetted into the false-twist nozzle to contain room temperature water in the form of mist.

Another object of the present invention is to raise the operating efficiency and to increase the strength of the yarn thus obtained, by giving the bundle of fibers supplied from the front rollers of the draft frame an asymmetric thickness distribution in the width direction.

Another object of the present invention is to raise the operating efficiency and to increase the strength of the yarn thus obtained, by giving the drafted bundle of fibers supplied from the front rollers a thickness distribution in which both wing portions are thicker than the central portion.

Still another object of the present invention is to prevent the diffusion of floating fibers and moisture, by introducing exhaust air with floating fibers or exhaust air containing floating fibers and water in the form of mist, separately from the yarn, into an exhaust duct having a small hole that permits the passage of the yarn, and by releasing air through a filter.

It is a further object of the present invention to provide an apparatus and false-twist nozzle suitable for producing such spun yarns.

Other objects will become apparent from the following explanation taken with the accompanying drawings, in which:

FIG. 4 is a front view, as seen from the line IV—IV in FIG. 3, of the yarn passageway portion of the false-twist nozzle.

FIG. 5 is an enlarged sectional view showing schematically the behavior of the bundle of fibers being treated by the false-twist nozzle in the passageway A, B, C in said nozzle.

FIG. 6 is a schematic diagram showing the distribution of the pressure of the fluid against the wall within the yarn passageway in the front view shown in FIG. 4, of the yarn passageway of the false-twist nozzle.

FIGS. 9, 10-1, 10-2 and 11 are graphs each showing the thickness distribution in the width direction of the fiber bundle at the nip line between the front rollers, which are the examples of thickness distributions suitable for practicing the method of the present invention.

Figure 1:
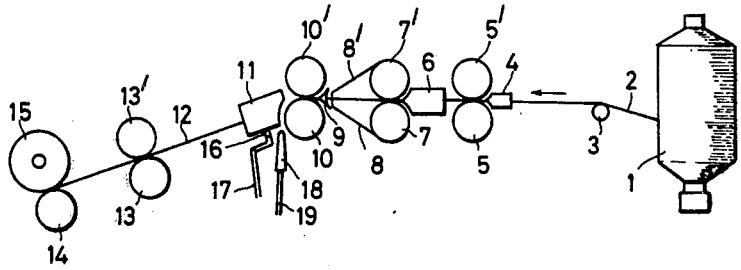
FIG. 1 is a schematic side view of an apparatus suitable for practicing the method of the present invention.
Figure 2:
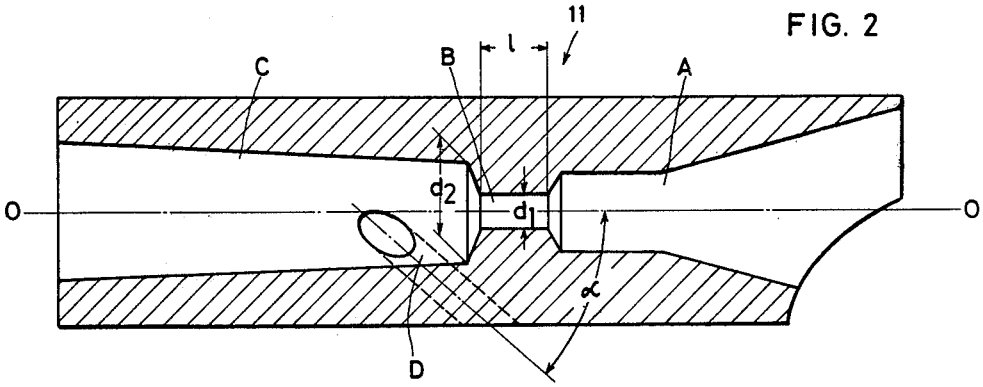
FIG. 2 is a side sectional view of an example of a false-twist nozzle for practicing the method of the present invention.

Referring to FIG. 1, a raw bundle of fibers 2 is taken off from package 1, and is led to trumpet 4 through yarn guide 3. The raw bundle of fibers 2 is then held by a pair of back rollers 5, 5' and while the width is restricted by collector 6, is break-draft between the back rollers 5, 5' and middle rollers 7, 7'. Subsequently, it is drafted to a predetermined thickness between the middle rollers 7, 7' and front rollers 10, 10', and is supplied to false-twist nozzle 11 provided adjacent front rollers 10, 10'. Reference numerals 8, 8' designate aprons covering middle rollers 7, 7', and 9 is a collector. The drafted bundle of fibers supplied to false-twist nozzle 11 is subjected to aspirating and rotating by a fluid flow supplied through pipe 17 connected to fluid inlet 16, whereby it is advanced, twisted and then untwisted to form spun yarn 12. The bundle of fibers is then held between a pair of delivery rollers 13, 13' rotated at a surface speed slower than that of front rollers 10, 10', and is wound up on package 15 rotated by contact with the surface of drum 14. To prevent the wrapping of fibers around front rollers 10, 10', pneumatic clearer 18, together with supply pipe 19, is provided in the space between front roller 10 and false-twist nozzle 11. False-twist nozzle 11 has a structure as shown in FIG. 2, and the yarn passageway, through which the bundle of fibers is passed while being twisted, consists of an upstream portion A, downstream portion C and narrow diameter throttle portion B connecting A and C. The shape of the upstream portion A is not limited to one particular shape, but the yarn inlet end extends into a trumpet shape so as to be suitable for collecting and introducing the flat fiber bundle 12 supplied from front rollers 10, 10', and is opposed to front rollers 10, 10' in spaced relation. The opposite end of portion A has a cylindrical shape having a relatively large diameter and is connected to the downstream portion C of the yarn passageway through an intermediate throttle portion B having a small diameter. At the downstream portion C of the yarn passageway, a fluid conduit D opens eccentrically into the yarn passageway and is inclined toward the outlet of the downstream portion.

In this false-twist nozzle 11, throttle portion B connecting upstream portion A and downstream portion C has a cylindrical shape, and its diameter $d_1$ (mm.) and its length 1 (mm.) must satisfy the following formulae in relation to the count Ne (English type cotton count) of the yarn to be spun:

$$2/\sqrt{Ne} < d_1 < 7/\sqrt{Ne}$$

$$0.25 \leqq d_1/d_2 \leqq 0.7$$

$$1/d_1 < 6$$

wherein $d_2$ is the diameter (mm.) of the starting end of downstream portion C connected to throttle portion B. Therefore, if the yarn to be spun is Ne 36, the diameter $d_1$ of throttle portion B is very small, being 0.3 – 1.1 mm. The reason for giving this diameter to such throttle portion B is not only to prevent the fluid jetted into the downstream portion C from flowing backward to the upstream end of the yarn passageway, but also to increase the aspirating effect at the inlet side of the yarn passageway. Also, it is intended to place the yarn at the starting end of the downstream portion C in a favorable running position according to the present invention, so as to fix the supporting point of rotation of the bundle of fibers being twisted by the rotating fluid, thereby stabilizing the amount of rotation of the yarn. In addition, the dimension of throttle portion B should be selected to be within the range which does not hinder the passage of the yarn.

To attain these objects, the diameter $d_1$ of throttle portion B should be determined, not by itself, but in relation to the diameter $d_2$ of the starting end of the downstream portion C of the yarn passageway. When such relation is expressed in the form of $d_1/d_2$, it is necessary that $d_1/d_2$ be within the range from not lower than 0.25 to not higher than 0.7. This is because, if the diameter $d_2$ of the starting end of downstream portion C of the yarn passageway exceeds 4 times the diameter $d_1$ of throttle portion B, the rotating power of fluid on the bundle of fibers travelling in the passageway of the false-twist nozzle 11 becomes unstable, thereby causing a large fluctuation or drop in the amount of twist of the bundle. Likewise, if $d_2$ is less than 1.43 (1/0.7), the fluid tends to flow backward to the upstream portion A of the yarn passageway, and the fluid does not draw the bundle of fibers and there is a tendency to wrap the delivered fibers around front rollers 10, 10'. Since the throttle portion B must make the yarn advance smoothly, an unnecesary length of portion B is not desirable although it depends to some extent on the diameter of throttle portion B. It is however, necessary that the length, as expressed by the ratio $1/d_1$, be smaller than 6, and from the viewpoint of practical use, it be sufficient that the length $l$ is generally in the range from 1 mm. to 5 mm., although it depends on the thickness of the bundle of fibers passing through. The shape of the downstream portion C of the yarn passageway is not particularly limited, if it has a sufficient size to permit free rotation or ballooning of the yarn to some extent. It may be cylindrical, but one of the most desirable examples is a conical shape, as shown in FIG. 2, expanding somewhat toward the outlet of the yarn passageway.

The farther the position of the opening of the fluid conduit D into the yarn passageway from the upstream end of downstream portion C and the nearer to the outlet end of the yarn passageway, the smaller the false-twist number given to the bundle of fibers passing through. It is desirable, therefore, that conduit D open into the yarn passageway in the range or positions from the upstream end of the downstream portion C of the passageway up to 3 times the diameter $d_2$ at said upstream end, as shown in FIG. 2. The fluid conduit D must open eccentrically into the downstream portion C of the yarn passageway, preferably tangentially to the inner wall of the downstream portion C, for providing false-twist by the rotation of the jetted fluid flow against the bundle of fibers passing through the yarn passageway in the false-twist nozzle. It is important that conduit D have an inclination of angle $\alpha$ with respect to the central axis of the yarn passageway so that the fluid jetted into the downstream portion C of the yarn passageway not only has a twisting effect but also an aspirating effect on the delivered bundle of fibers, thereby helping the thus-obtained spun yarn 12 to travel smoothly. It is desirable that the conduit D have an inclination angle of $\pi/6$ to $\pi/4$, depending on the thickness of the yarn to be spun and the spinning speed, that is to say, if the yarn count is within the range of from 10's to 85's and the spinning speed is within the range from 100 to 150 m./min.

Figure 3:
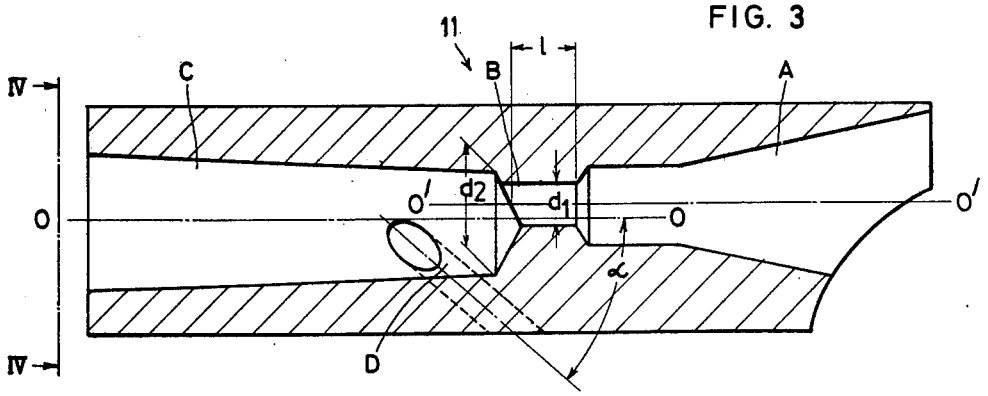
FIG. 3 is a side sectional view of another example of a false-twist nozzle suitable for practicing the method of the present invention.

FIG. 3 is a side view of another false-twist nozzle according to the present invention having an especially desirable performance, and FIG. 4 is a front view, as seen from the line IV—IV, of the false-twist nozzle shown in FIG. 3. The structural feature of this false-twist nozzle is that the central axis O'—O' of the upstream portion A and throttle portion B are eccentrically positioned in a direction toward the side of the cross section of the downstream end opposite the position of fluid conduit D, the direction being in the same direction as that in which the conduit D extends into the downstream portion C. Namely, in the plane PQRS (FIGS. 5 and 6) perpendicular to the central axis O—O of the downstream portion C of the yarn passageway at the starting end of lower stream portion C of the yarn passageway, and on having plane axes X—X and Y—Y which intersect the axis O—O and are respectively perpendicular and parallel to the parallel component on said plane of fluid conduit D, the central axis O'—O' of throttle portion B must be located within the semicircle PQROP formed by connecting the points P, Q, R, O, P on the wall of lower stream portion C of the yarn passageway. (Taking the position of the opening of fluid conduit D into the downstream portion C as being situated in the third quadrant (FIG. 6), this semicircle PQROP consists of the first and second quadrants.) The central axis O'—O' of throttle portion B must not be located within the semicircle RSPOR (the third and fourth quadrants). The reason is to maintain as constant as possible the product of the length of a moment arm of the bundle of fibers extending to lower stream portion C of the yarn passageway and the pressure of the fluid flow, by causing the twisted bundle of fibers to form a supporting point in throttle portion B, in order to stabilize the rotating power exerted on the travelling bundle of fibers. Namely, throttle portion B is positioned eccentrically as described above so that in a zone where the rotating power obtained by the fluid flow is very strong, the distance between its acting point and the supporting point of the bundle of fibers (throttle portion B) becomes small.

FIG. 6 shows the distribution of pressure exerted on the inner wall of the downstream portion C of the yarn passageway by the jetted-in fluid in the neighborhood of the opening of fluid conduit D. In order to maintain the product of the pressure and the length of the moment arm of the yarn centering around the axis O'—O' of the upstream portion A of the yarn passageway and to prevent the yarn from staying in the negative pressure areas in the fourth quadrant shown in FIG. 6, the amount of eccentricity of O' with respect to O, namely $\epsilon_1$ ($\epsilon_1 \geqq 0$) on the $\gamma$ axis and $\epsilon_2$ on the X axis should be suitably selected. Of course, the amounts of eccentricity are limited. In the eccentric position, the inner wall of throttle portion B must not be located beyond that of the downstream portion C of the yarn passageway. Accordingly, the central axis O'—O' of throttle portion B must be established at a postion shifted from the central axis at least $d_1/2$ from the inner wall of the diameter of the starting end of the downstream portion C. It is preferable that the center of the upstream portion A of the yarn passageway is concentric with throttle portion B, to provide for smoothness of yarn passing therethrough and from the stand point of manufacturing the false-twist nozzle, but this is not absolutely necessary. By eccentrically positioning throttle portion B with respect to the downstream portion C in the specific direction as described above, the twisting power of the fluid flow is stabilized and practical properties of the yarn, such as strength and elongation at the breaking tension and stability of the spun yarn with respect to abrasion are improved, and moreover when using air as fluid, even when the supply pressure is lowered to reduce the rate of use, it is possible to obtain a spun yarn having excellent physical properties which is sufficient for practical use, so that the lowering reduction of the production cost as a result of reduction of the amount of energy used is great. Furthermore, there is substantially no limitation on the fiber length of the raw material fibers. It is possible to spin short fibers, for example, 38 mm. cut polyester staple fiber or blended fibers of 38 mm. cut polyester fiber and cotton into the yarn, at a high speed of 150 m./min. Of course, there is no necessity to use supplementary means, such as adhesion or fusion, for yarn formation. Thus, the false-twist nozzle according to the present invention has the above-mentioned features.

When twisting yarns with this false-twist nozzle, it goes without saying that a better twisting effect can be obtained when the yarn is maintained under a relatively weak tension by over feeding the yarn in the twisting zone, as is well known.

Figure 7:
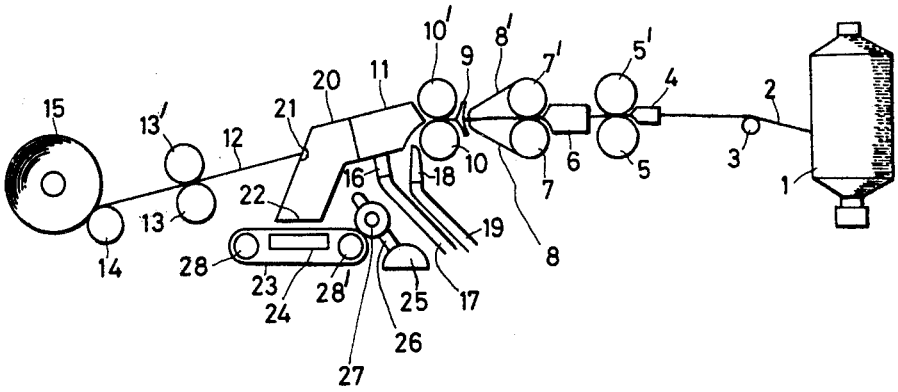
FIG. 7 is a schematic side view of another example of an apparatus suitable for practicing the present invention.

As the fluid to be used for the false-twist nozzle 11 according to the present invention, air is most suitable from the standpoint of safety, economy, hygiene and operation. High pressure air compressed by a compressor is supplied at false-twist nozzles 11 mounted to each spindle of the spinning machine. The high pressure air supplied to each false-twist nozzle 11 is jetted through fluid conduit D into the downstream portion C of the yarn passageway, with the conduit D being inclined toward the yarn outlet and eccentrically positioned, so as to lead, twist and untwist the bundle of fibers supplied from front rollers 10, 10' to form the spun yarn stably, and is discharged from the outlet of the yarn passageway, together with the spun yarn. The air discharged from false-twist nozzle 11 may be released directly into the room, but since this air usually contains a small amount of fibers and their fragments in the form of floating fibers, it is preferable to lead the discharged air, after it is separated from spun yarn 12, to a duct 20, provided at the nozzle outlet side and, having a small opening 21, as shown in FIG. 7, which permits the passage of the yarn, and to release the discharged air to the atmosphere after removing the floating fibers at the outlet 22 of duct 20 by means of a filter means 23. The specific filter means 23 shown in the figures is a fine wire gauze which extends around rollers 28, 28' in the form of an endless belt, and removes floating fibers contained in the air discharged from duct outlet 22, while moving at a slow speed. For this purpose, an active aspirating means 24 may be provided on the other side of the filter 23 opposite the duct outlet 22. Also, it is convenient to provide a means which removes fibers or fiber fragments accumulated on filter 23 by a scraper roller 27 rotated in contact with filter 23 and pressed thereagainst by an arm 26 rotatable about a support 25.

Figure 8:
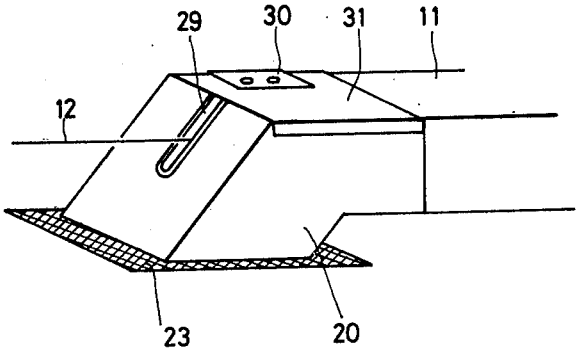
FIG. 8 is a perspective showing another example of the exhaust duct.

In order to facilitate threading the yarn through opening 21 in duct 20, it is convenient to shape said opening 21 in the form of a narrow slit 29 and to provide a single door 31 having a hinge 30 at one side of duct 20, as shown in FIG. 8. To carry out the threading, it is sufficient to simply open door 31, thread yarn 12 discharged from false-twist nozzle 11 through the narrow slit 29, and close the door 31 to prevent leakage of the discharged air. The effect of this duct 20 is significant, since, especially when short fibers below 50 mm. in length, such as cotton or polyester short staple fibers for use in blending with cotton, are contained in the raw material fibers, the ratio of floating fibers contained in the discharged air becomes high, so the provision of this type of duct is very desirable.

The mixing of an extremely small amount of water in the form of mist with the air flow in this spinning method, not only leads to an improvement in operating efficiency, the breaking strength of the yarn and stability with respect to abrasion, but also is very important in that it can bring a reduction in the amount of air used. Compressed air may contain an extremely small amount of water in the form of vapor, but usually cannot contain an amount of moisture larger than the amount necessary to make it saturated with water vapor, although the amount of moisture amount depends on the type and performance of the apparatus used for producing and conveying the compressed air. In the present invention, it is recommended to add water in the compressed air supply pipe 17 by means of a suitable method which can add a predetermined amount of water to the pressurized air at a position in the neighborhood of false-twist nozzle 11. If, however, water is added along the inner wall of air supply pipe 17, it is difficult to diffuse water into air in the form of mist, so that it is desirable to add the water in the central portion of air supply pipe 17. Although the amount of water to be added into the air flow should be determined depending on the amount of the fibers to be spun, if it is too small the effect is insufficient, and too large an amount will decrease the strength of the yarn obtained. About 2 - 50 c.c. or preferably 10 - 30 c.c. of water for each 100 normal liters of air is adequate. The effect of the addition of water is particularly marked when the material being treated is hygroscopic like cotton and wool. But the effect is not limited to such material, and is clearly observed even in the case of fibers having no substantial hygroscopicity, such as polyester staple fiber, and particularly when the fiber length is short. The strength and elongation at the breaking strength and stability with respect to abrasion of the thus obtained yarn are increased so as to form strong yarn, with extremely good properties. It is considered that such improvements are due to the fact that, because of an increase in the frictional coefficient of the fibers due to the wetting of fibers by water or the removal of oil from fiber surfaces, the fiber ends because entangled tightly around the fiber bundle.

The water used here is not limited to pure water, and may contain a very small amount of other components, such as water-soluble gas, liquid and/or water-insoluble solids. But water-soluble solids should not be present, because after the yarn has been discharged from the false-twist nozzle, the solids accumulate and solidify around the duct outlet and cause difficulities. Accordingly, the use of water-soluble sizing agents should be avoided. Also, water-insoluble solids, when large in size, will clog the nozzle conduit and impair the performance of the false-twist nozzle, so that they must be removed in advance from the water. The water used here must absolutely be at room temperature. Discharge of high-temperature steam containing a large amount of water through the false-twist nozzle not only disturbs the temperature-humidity condition in the spinning room, but also causes danger in the operation and causes problems such as rust on the machine and loss of energy. Therefore, it is preferable to mix into the air flow, water at a temperature below 40° C., preferably about 25° C., which can be handled without difficulty. When mixing a very small amount of water with the air to be jetted into the false-twist nozzle, it is necessary to provide a discharge duct 20 at the outlet side of the false-twist nozzle 11 to prevent the scattering of water. It is also necessary to protect the machine and its environment from wetting, by providing a means for collecting and removing excess water at the outlet side of discharge duct 20. The yarn thus spun by air flow containing an amount of water greater than the amount of saturated vapor is a little wet and contains some water within the package. But the yarn is gradually air-dried during winding, and after standing for several hours to several days after doffing, it is dried to equilibrium moisture content again, so that it causes no difficulty in practice use. To accelerate air-drying, the spun yarn may be wound up on a porous bobbin, or may be subjected to a heat-treatment at a suitable temperature in an autoclave.

It is important in the present invention to cause the bundle of fibers supplied to the false-twist nozzle to have a particular thickness distribution in the width direction, as another effective means to raise operating efficiency and improve the physical properties of the yarn, such as strength.

One method is to supply to the false-twist nozzle, a bundle of fibers the thickness of which in the width direction at the nip line of the front rollers of the draft frame is asymmetric in relation to the center line $Y_o$—$Y_o$ of the bundle of fibers, as shown in FIG. 9. For the bundle of fibers having such a thickness distribution, it is desirable that the line $Y_1$—$Y_1$ through the center of gravity of the area under the thickness distribution curve and which intersects the surface XX of the front bottom roller coincides with center of the yarn passageway of the false-twist nozzle. As for the twisting direction of the false-twist nozzle, it is preferable that the direction should be such that the fibers on the side of axis $Y_1$—$Y_1$ containing the central axis $Y_o$—$Y_o$, i.e. on the wide side of the bundle are separated from the bottom roller surface XX after the bundle of fibers passes the nip line of the front rollers, advances along the front bottom roller surface and then is supplied to the false-twist nozzle.

The reason why a fiber bundle having such an asymmetric thickness distribution has a desirable effect on the formation of yarn is as follows: The portion E, as shown in FIG. 9, which is the central portion of the bundle of fibers, is twisted regularly at the center of twisting to form the core portion of the yarn continuously. The portions F and F′ situated on both sides of portion E are spaced from the nip line of the front rollers, and when twisted, they are substantially free from restraint by the succeeding fibers because of their small thickness. Therefore, portions F and F′ portions can move relatively freely, and become entangled around the core fibers somewhat at random. The fibers at the portions G, G′ at both edges are even more weakly restrained and can move very freely, so that they are wrapped around the portions E, F, and F′ at random. When they are untwisted after going through the false-twist nozzle, the portions fibers at the F, F′ are wrapped around the portion E which become the core of the spun yarn and which has been formed regularly at a relatively small inclination angle and yet relatively densely. Around the portions F, F′ are wrapped fibers of the portions G, G′ at random at a larger inclination angle and/or a reverse inclination angle, to form a stabilized yarn having a three-layer structure. Thus, it is possible to obtain a yarn which is highly efficient in use and has excellent strength. When the bundle of fibers advances along the bottom roller surface, after passing the nip line between the front rollers, the above mentioned fact that the desirable direction of false-twist is such as to separate the fibers at portions F and G from the bottom roller, is because, if the fibers delivered from the nip line are twisted so that they approach the bottom roller, the free movement of the fibers is hindered by friction with the roller surface and therefore the entanglement or wrapping of fibers after untwisting becomes loose.

A bundle of fibers having such an asymmetric thickness distribution can be produced by supplying a relatively thick bundle of raw material fibers to a draft frame, while the shifting bundle guides (called collectors and usually provided between pairs of draft rollers) alternately from the central axis along which the bundle of fibers normally passes, and thereby moving fibers to one side along the front roller nip line so that the fiber bundle finally will have an asymmetric thickness distribution.

Also, another form of the bundle of fibers which produces a favorable effect in the present invention is one in which both edge portions of the bundle at the front nip line are thicker than the central portion, and the sizes of the edge portions are symmetrical or asymmetrical, as shown in FIGS. 10–1 and 10–2. To this end, the supplied raw bundle of fibers, upon being drafted by the draft frame, is divided into two portions by a collector having a raised portion at the center, or two raw bundle of fibers are supplied to the draft frame with a space between them.

For the spinning of a fine count yarn, it is recommended that more than 60% of the total number of fibers be in the middle ⅓ of the width of the bundle of fibers, as shown in FIG. 11, with the whole width of the bundle being maintained, whereby a continuous, stable core portion is formed. To this end, it is effective to make the bundle as narrow as possible by the collectr between the draft rollers, together with the trumpet behind the back rollers and to expand it at a stroke to a predetermined width in one step in front of the front rollers. In this case, the thickness distribution is desirably asymmetric with respect to the central axis of the width, as described above, but is not limited to that.

Thus, the present invention is a useful one which makes it possible to obtain a spun yarn, which is very practical and comparable to conventional ring yarn, even from a bundle of fibers composed of short fibers less than 50 mm. in length, by using these techniques singly or in combination.

EXAMPLE 1

Two rovings, each weighing 0.3 grams per meter and having a twist coefficient of 0.5, composed of polyester staple fibers (1.5 den. × 38 mm.) were supplied to an apparatus as shown in FIG. 1 under the following conditions:

Yarn count: Ne 45
Draft frame: 3-line type apron draft frame
Total draft ratio between front rollers and back rollers: 47
Surface speed of front rollers: 160 m./min.
Surface speed of delivery rollers: 152 m./min.
Type of the nozzle used: that shown in FIG. 2
Diameter of air conduit: 1.2 mm.$\phi$
Inclination angle ($\alpha$) of air conduit: 35°

The following table shows the conditions of operation and properties of spun yarn for different nozzle dimensions. Properties of the yarn include strength at breaking point (*g*) shown by average strength (*n.* = 100) obtained by an Uster Automatic Yarn Strength Tester, variation in strength (%), elongation at point of breaking (%) and stability with respect to abrasion. The latter is shown by the number of times the yarn is rubbed by a yarn abrasion tester until it breaks. The yarn being tested under a load of 30 g. is rubbed repeatedly with a needle while being bent by said needle.

Table 1

| Sample No. | Nozzle dimensions $d_1$ | $d_2$ | 1 | State of operation | Properties of spun yarn: Strength at break (g) | C.V.* of strength at break (%) | Elongation at break (%) | Stability against abrasion |
|---|---|---|---|---|---|---|---|---|
| 1 | 0.4 | 1.5 | 2 | Spinning possible | 147 | 21 | 11.6 | 40 |
| 2 | 0.6 | 2.0 | 3 | Spinning possible | 172 | 19 | 12.3 | 51 |
| 3 | 0.8 | 2.5 | 3 | Operation good | 251 | 14 | 13.2 | 86 |
| 4 | 1.0 | 2.5 | 3 | Operation good | 242 | 15 | 14.0 | 73 |
| 5 | 1.4 | 2.5 | 3 | Spinning possible; yarn qualities poor | 138 | 21 | 10.6 | 32 |

Table 1-continued

| Sample No. | Nozzle dimensions $d_1$ | $d_2$ | l | State of operation | Properties of spun yarn: Strength at break (g) | C.V.* of strength at break (%) | Elongation at break (%) | Stability against abrasion |
|---|---|---|---|---|---|---|---|---|
| 6 | 0.8 | 1.5 | 3 | Operation good | 207 | 16 | 12.3 | 71 |
| 7 | 0.8 | 2.5 | 10 | Many yarn breaks; operation impossible | — | — | — | — |

*C.V. = coefficient of variation.

As shown in Table 1, all of samples Nos. 1, 2, 3, 4 and 6 were produced by nozzles with dimensions which are within the range of the present invention. The conditions under which these samples were made are conditions which are possible to achieve or are good operating conditions and among others. Nos. 3, 4 and 6 gave good yarn qualities which are sufficient for practical use. On the contrary, sample Nos. 5 and 7, produced by nozzles with dimensions outside of the range of the present invention, had extremely poor yarn qualities, even if spinnable, or spinning was impossible. In this example, the thickness distribution in the width direction of the bundle of fibers on the front roller nip line was as shown in FIG. 10-1.

EXAMPLE 2

A raw sliver composed of 65% polyester staple fibers (1.5 den. × 38 mm.) and 35% combed cotton, and weighing 4.0 grams per meter was supplied to an apparatus similar to that of FIG. 1 under the following conditions:

Yarn count: Ne 20
Draft frame: 4-line type apron draft frame
Surface speed of front rollers: 154 m./min.
Surface speed of delivery rollers: 146 m./min.
Type of nozzle used: that shown in FIG. 2
Diameter of air conduit: 1.2 mm.$^{\phi}$
Gauge pressure of air introduced: 3.5 kg./cm.$^2$ As shown in Table 2, when using a false-twist nozzle having yarn passageway dimensions falling within the range of the present invention as in samples Nos. 9, 10, 11, 12, 13 and 15, the yarns could be spun under operating conditions which were possible to achieve or which were fairly good, but there was a large fluctuation in strength at the breaking point, so that their use is limited. In samples Nos. 8 and 14; the yarn passageway dimensions were out of the range of the present invention and the yarn could not be spun or had extremely poor yarn qualities and were of no practical use.

EXAMPLE 3

Blended fibers composed of 65% polyester staple fibers (1.5 den. × 38 mm.) and 35% combed cotton fibers were uses as raw material, and a drawing sliver weighing 5 grams per meter was supplied to an apparatus similar to that of FIG. 1 under the following conditions:

Yarn count: Ne 40
Draft frame: 4-line type apron draft frame
Total draft ratio between front rollers and back rollers: 349
Surface speed of front rollers: 155 m./min.
Surface speed of delivery rollers: 148 m./min.
Type of nozzle used: that shown in FIG. 2 or FIG. 3
Diameter of the throttle portion: 0.8 mm.$^{\phi}$
Diameter of the downstream portion: 2.3 mm.$^{\phi}$
Gauge pressure of supplied air: 3.5 kg./cm.$^2$ Table 2

| Sample No. | Nozzle dimensions $d_1$ | $d_2$ | l | State of operation | Properties of spun yarn: Strength at break (%) | C.V. of strength at break (%) | Elongation at break (%) | Stability against abrasion |
|---|---|---|---|---|---|---|---|---|
| 8 | 0.4 | 1.5 | 2 | Spinning impossible | — | — | — | — |
| 9 | 0.6 | 2.0 | 3 | Spinning possible; much yarn break | 152 | 32 | 10.2 | 32 |
| 10 | 0.8 | 2.5 | 3 | Operation almost good | 190 | 30 | 12.2 | 67 |
| 11 | 1.0 | 2.5 | 3 | Operation almost good | 207 | 28 | 13.3 | 73 |
| 12 | 1.4 | 2.5 | 3 | Operation almost good | 182 | 31 | 11.6 | 52 |
| 13 | 1.6 | 2.5 | 3 | Spinning possible; many yarn breaks | 151 | 33 | 10.1 | 38 |
| 14 | 1.4 | 1.6 | 3 | Spinning possible; many yarn breaks | 100 | 42 | 7.9 | 13 |
| 15 | 1.4 | 2.0 | 3 | Operation almost good | 179 | 30 | 12.5 | 53 |

Table 3

| Sample No. | Nozzle dimensions Type | $\epsilon_1$ (mm.) | $\epsilon_2$ (mm.) | Position (quadrant) of the throttle portion | Yarn properties Strength at break (g) | C.V. of strength (%) | Elongation at break (%) | Stability against abrasion |
|---|---|---|---|---|---|---|---|---|
| 16 | FIG. 2 | 0 | 0 | | 176 | 16 | 11.2 | 70 |
| 17 | FIG. 3 | + 0.2 | + 0.2 | I | 208 | 13 | 12.0 | 105 |
| 18 | FIG. 3 | + 0.2 | − 0.2 | II | 221 | 12 | 12.2 | 112 |
| 19 | FIG. 3 | − 0.2 | − 0.2 | III | 109 | 32 | 7.8 | 34 |
| 20 | FIG. 3 | − 0.2 | + 0.2 | IV | 138 | 25 | 9.5 | 32 |

As shown in Table 3, the nozzle of Sample No. 16 is a nozzle in which the upstream portion and the downstream portion are not arranged eccentrically with respect to each other. Sample Nos. 17, 18, 19 and 20 are made with nozzles in which the up- stream portion the throttle portion are eccentrically positioned in relation to the downstream portion. Nos. 17 and 18 are made with nozzles in which the upstream portion and throttle portion are both positioned eccentrically toward the opposite side of the cross-section of the downstream portion from the positions of the opening of the fluid conduit thereinto and had, good operability and produced a yarn having a low fluctuation in strength at the break point and, which was superior to a normal yarn such as sample No. 16.

EXAMPLE 4

Two rovings (0.6 grams per meter) using cotton as the raw material were supplied to an apparatus as shown in FIG. 7 under the following conditions:

Yarn count: Ne 20
Draft frame: 3-line type apron draft frame
Total draft ratio between front rollers and back rollers: 44
Surface speed of front rollers: 150 m./min.
Surface speed of delivery rollers: 143 m./min.
Type of nozzle used: that shown in FIG. 3
Diameter of air conduit: 1.1 mm.$^{\phi}$
Diameter of lower stream portion: 2.3 mm.$^{\phi}$
Diameter of throttle portion: 0.8 mm.$^{\phi}$
Length of throttle portion: 3 mm.
Amounts of eccentricity: $\epsilon_1 = 0.2$ mm., $\epsilon_2 = -0.1$ mm.
Amount of supplied air: 35 N.l./min.

Water of a quality suitable for drinking was mixed into the introduced air and was supplied to the false-twist nozzle in the form of mist. Table 4 shows the relationship between the amount of water supplied and spun yarn qualities. For the mixing of water, the lubricator was of the type for adding oil to air in the form of mist and generally used in compressed air apparatus.

Table 4

| No. | Amount of water (c.c./min.) | Strength at break (g) | C.V. in strength (%) | Elongation at break (%) | Stability against abrasion |
|---|---|---|---|---|---|
| 21 | 0 | 151 | 16 | 8.4 | 26 |
| 22 | 1.3 | 171 | 12 | 8.4 | 49 |
| 23 | 2.3 | 192 | 10 | 9.2 | 70 |
| 24 | 4.0 | 203 | 9 | 10.2 | 76 |
| 25 | 5.3 | 215 | 7 | 11.2 | 100 |
| 26 | 6.6 | 195 | 9 | 10.0 | 51 |
| 27 | 10.7 | 180 | 10 | 10.4 | 62 |
| 28 | 14.7 | 165 | 12 | 9.3 | 67 |

As shown in Table 4, with the increase of the amount of water, the yarn qualities are improved, but with an excess amount, the yarn qualities tends to fall off. An amount of 2.3 – 10.7 c.c./min. was suitable. In each sample, the thickness distribution in the width direction of the bundle of fibers on the front rollers nip line was as in FIG. 10-1.

EXAMPLE 5

A sliver (4.7 grams per meter) composed of polyester fibers (1.5 den. × 38 mm.) was supplied to an apparatus similar to that of FIG. 7 under the following conditions:

Yarn count: Ne 30
Draft frame: 4-line apron draft frame
Total draft ratio between front rollers and back rollers: 246
Surface speed of front rollers: 170 m./min.
Surface speed of delivery rollers: 161.5 m./min.
Type of nozzle used: that shown in FIG. 3
Amount of supplied air: 40 N.l./min.

Table 5 shows the properties of the spun yarn obtained with different amounts of water when it is mixed into the introduced air by a lubricator.

Table 5

| No. | Amount of water (c.c./min.) | Strength at break (g) | C.V. of strength (%) | Elongation at break (%) |
|---|---|---|---|---|
| 29 | 0 | 384 | 14 | 13.7 |
| 30 | 1.9 | 460 | 13 | 16.0 |
| 31 | 3.7 | 452 | 11 | 15.6 |
| 32 | 4.3 | 456 | 11 | 16.3 |
| 33 | 5.2 | 455 | 13 | 15.4 |
| 34 | 7.0 | 405 | 15 | 15.0 |
| 35 | 12.0 | 398 | 14 | 15.4 |
| 36 | 16.1 | 378 | 17 | 14.6 |

EXAMPLE 6

A drawing sliver (5 grams per meter) composed of blended fibers consisting of 65% polyester staple fibers (1.5 den. × 38 mm.) and 35% combed cotton fibers, was supplied to an apparatus similar to that of FIG. 1 under the following conditions:

Yarn count: Ne 45
Draft frame: 4-line type apron draft frame
Total draft ratio between front rollers and back rollers: 397
Surface speed of front rollers: 150 m./min.
Surface speed of delivery rollers: 142 m./min.
Type of nozzle used: that shown in FIG. 3
Gauge pressure of jetted-in air: 3.5 kg./cm.$^2$
Direction of false-twist: S → Z Under the above described conditions, spun yarns were produced from a bundle of fibers having various predetermined thicknesses, while the width and position of the width-controlling collector were changed. The degree of yarn breakage was observed. The results are as follows:

Table 6

| | No. | Unit (mm.) 37 | 38 | 39 | 40 | 41 |
|---|---|---|---|---|---|---|
| Width-coht-rolling col- | Width Shift | 4 | 4 | 4 | 8 | 4 |

Table 6-continued

| | No. | Unit (mm.) 37 | 38 | 39 | 40 | 41 |
|---|---|---|---|---|---|---|
| lector between back and third rollers | from yarn axis | Right 1.5 | Right 2.0 | 0 | Left 2.0 | Left 1.5 |
| Width-controlling collector between third and second rollers | Width | 7 | 7 | 7 | 7 | 7 |
| | Shift from yarn axis | Left 0.5 | Left 1.0 | 0 | Right 0.7 | Right 0.5 |
| Degree of yarn breakage | | A | B | C | D | C |

A : No yarn breakage
B : Slight yarn breakage
C : Frequent yarn breakage
D : Spinning is difficult The trumpet was 8 mm. in width, and was moved to the central axis of the width-controlling collector between the back and third rollers. In this example, the center of the gravity of thickness distribution of the bundle of fibers on the front roller nip line was on the line segment passing the center of the throttle portion of the air nozzle, that is to say, on the central axis at the upstream side of the air nozzle. Said central axis was caused to perpendicularly intersect the rotary axis of the front rollers. On the front roller nip line, samples Nos. 37 and 38 had a thickness distribution of the bundle of fibers as shown in FIG. 9. The yarn of sample No. 37 was measured for its yarn qualities by an Uster Automatic yarn Strength Tester (the number of test 200 times), and it was found that the strength at the breaking point was 181 g and elongation was 12.2%. When the yarn was supplied to a knitting machine, it showed good practical properties.

EXAMPLE 7

Example 6 was repeated using the nozzle of sample No. 17 to spin a Ne 50 yarn. In this case, a thickness distribution of the bundle of fibers corresponding to that in FIG. 10-1 was produced by a collector having a raised portion in the middle, whereby the yarn strength was increased. While the strength at the breaking point was 162 g when the thickness distribution was regular, the strength was increased to 175 g by using a collector of this type.

EXAMPLE 8

Example 6 was repeated using the nozzle of sample No. 17 to spin a Ne 60 yarn. In this case, the width of the width-controlling collector between the back and third rollers was 3 mm. and the width of the width-controlling collector between the third rollers and second apron rollers 4 mm., so as to produce a thickness distribution of the fiber bundle as in FIG. 11, with the result that there was almost no yarn breakage and continuous spinning became possible.

What is claimed is:

1. A method of producing a spun yarn, comprising: continuously delivering from the front rollers a draft frame a bundle of fibers which have been drafted, feeding the drafted bundle of fibers directly through an upstream portion, a small diameter throttle portion and a downstream portion of a yarn twisting passageway having the dimensions in the relationship:

$$2/\sqrt{Ne} < d_1 < 7/\sqrt{Ne}$$

$$0.25 \leqq d_1/d_2 \leqq 0.7$$

$$1/d_1 \leqq 6$$

wherein $d_1$ is the diameter (mm.) of the throttle portion, $d_2$ is the diameter (mm.) of the upstream end of the downstream portion of the yarn passageway, 1 is the axial length (mm.) of the throttle portion, and Ne is the yarn count (English type cotton count) of the yarn being spun; feeding a single stream of fluid into the upstream end of the downstream potion of the yarn twisting passageway eccentrically of and at an acute angle to the axis of said yarn twisting passageway and inclined toward the downstream end of the yarn twisting passageway for twisting and untwisting the drafted bundle of fibers with a false twist while overfeeding the bundle of fibers, and delivering the thus twisted and untwisted bundle of fibers through delivery rolls and winding the delivered spun yarn.

2. The method as claimed in claim 1 in which the downstream portion of the yarn twisting passageway is eccentric with respect to the axis of the throttle portion of the yarn twisting passageway and said stream of fluid is supplied to said downstream portion from the side of said portion on the opposite side of the downstream portion, in the direction opposite to that in which the stream of fluid is fed into the downstream portion, from the side into which the axis of said throttle portion extends.

3. The method as claimed in claim 2, in which the bundle of raw material fibers is composed only of short fibers less than 50 mm. in length.

4. The method as claimed in claim 2 in which the fluid is air mixed with water in the form of mist at room temperature water and in an amount in excess of the amount necessary to saturate the air with water vapor.

5. The method as claimed in claim 2 further comprising making the thickness distribution in the direction of the width of the bundle of fibers on the nip line of the front rollers of the draft frame asymmetric.

6. The method as claimed in claim 5 in which more than 60% of the fibers are concentrated in one third of the total width of the bundle of fibers.

7. The method as claimed in claim 5 in which the thickness distribution of the bundle of fibers is such that the longitudinal edge portions are thicker than the central portion.

8. The method as claimed in claim 2 separating the fluid from the spun yarn by passing the spun yarn through a duct having a yarn removing hole, and then filtering the fluid discharged from the duct.

9. A spinning apparatus comprising: a set of drafting rollers having a pair of front rollers; delivery rollers spaced from said front rollers; and a false-twist nozzle between said front rollers and said delivery rollers and immediately adjacent said front rollers, said false-twist nozzle having a yarn passageway composed of an upstream portion, a throttle portion and a downstream portion, and a single fluid conduit opening into the upstream end of the downstream portion of said yarn passageway eccentrically and at an acute angle to the longitudinal axis of said yarn passageway and inclined toward the downstream end of the yarn passageway said yarn passageway having dimensions in the relationship:

$$2/\sqrt{Ne} < d_1 < 7/\sqrt{Ne}$$

$$0.25 \leqq d_1/d_2 \leqq 0.7$$

$1/d_1 < 6$ wherein $d_1$ is the diameter (mm.) of the throttle portion, $d_2$ is the diameter (mm.) of the upstream end of the downstream of the yarn passageway, $l$ is the axial length (mm.) of the throttle portion, and Ne is the yarn count (English type cotton count) of the yarn to be spun; and means connected to said fluid conduit for supplying fluid under pressure thereto.

10. A spinning apparatus as claimed in claim 9 in which said downstream portion of said yarn passageway is eccentric with respect to the axis of the throttle portion of the yarn passageway and said fluid conduit opens into said downstream portion of said yarn passageway from the side of said portion on the opposite side of the downstream portion, in the direction opposite to that in which the fluid conduit extends, from the side into which the axis of said throttle portion extends.

11. The spinning apparatus as claimed in claim 10 further comprising a duct having a yarn-passing hole therein at the downstream end of the false-twist nozzle for receiving the yarn and fluid discharged from said nozzle through the inlet end thereof and passing the yarn out through the yarn passing hole and a filter at the outlet end of said duct.

12. The spinning apparatus as claimed in claim 10 in which said means for supplying fluid under pressure comprises means for mixing air and water in the form of mist at room temperature and in an amount in excess of that needed to saturate the air and supplying said mixture to said fluid conduit.

13. The spinning apparatus as claimed in claim 10 in which said drafting rollers have collectors between the sets of rollers which are positioned out of alignment with the longitudinal axis of the upstream portion of the yarn passageway of the false-twist nozzle.

14. The spinning apparatus as claimed in claim 10 further comprising means in said set of drafting rollers between the sets of drafting rollers for dividing the bundle of fibers being drafted into two portions.

15. A false-twist nozzle for a yarn spinning apparatus, said nozzle having a passageway composed of an upstream portion, a throttle portion and a downstream portion, and a single fluid conduit opening into the upstream end of the downstream portion of the yarn passageway eccentrically and at an acute angle to the longitudinal axis of the yarn passageway and inclined toward the downstream end of the yarn passageway, and said yarn passageway having dimensions in the relationship:

$$2/\sqrt{Ne} < d_1 < 7/\sqrt{Ne}$$

$$0.25 \leqq d_1/d_2 \leqq 0.7$$

$$1/d_1 < 6$$

wherein $d_1$ is the diameter (mm.) of the throttle portion, $d_2$ is the diameter (mm.) of the upstream end of the downstream portion of the yarn passageway, $l$ is the axial length (mm.) of the throttle portion, and Ne is the yarn count (English type cotton count) of the yarn to be spun.

16. A spinning apparatus as claimed in claim 15 in which said downstream portion of said yarn passageway is eccentric with respect to the axis of the throttle portion of the yarn passageway and said fluid conduit opens into said downstream portion of said yarn passageway from the side of said portion on the opposite side of the downstream portion, in the direction opposite to that in which the fluid conduit extends, from the side into which the axis of said throttle portion extends.

* * * * *